United States Patent [19]

Kann

[11] 4,171,545

[45] Oct. 23, 1979

[54] MODULAR LAVATORY CONSTRUCTION

[75] Inventor: Henry R. Kann, New York, N.Y.

[73] Assignee: The Charles Parker Company, Meriden, Conn.

[21] Appl. No.: 489,540

[22] Filed: Jul. 19, 1974

[51] Int. Cl.[2] ..... A47K 1/00; A47K 1/04; E03C 1/32

[52] U.S. Cl. ..... 4/1; 4/166; 52/35; 312/228; 312/245; D6/181; D23/49

[58] Field of Search ..... 4/1–5, 4/8, 114, 166, 191, 192, DIG. 7, 187 R, 167; 312/138 A, 245, 228; 52/34, 35; D23/49, 69; D6/127, 130, 181, 186, 188, 190

[56] References Cited

U.S. PATENT DOCUMENTS

| | | | |
|---|---|---|---|
| D. 143,659 | 1/1946 | Irwin | D6/186 |
| D. 179,655 | 2/1957 | Piotraschke | D23/49 X |
| D. 179,656 | 2/1957 | Piotraschke | D23/49 X |
| D. 189,247 | 11/1960 | Piotraschke | D23/49 X |
| D. 219,491 | 12/1970 | Leath | D6/186 |
| D. 220,102 | 3/1971 | Conner | D23/49 |
| D. 228,066 | 8/1973 | Humphries | D23/49 |
| D. 232,893 | 9/1974 | Moretini | D6/181 X |
| 1,978,842 | 10/1934 | Hooton | 52/53 |
| 3,337,172 | 8/1967 | Jackson | 312/245 X |
| 3,496,577 | 2/1970 | Saldana | 4/1 |
| 3,590,393 | 7/1971 | Hollander et al. | 4/2 |
| 3,766,574 | 10/1973 | Smid | 4/2 X |

*Primary Examiner*—Stuart S. Levy

*Attorney, Agent, or Firm*—Hopgood, Calimafde, Kalil, Blaustein & Lieberman

[57] ABSTRACT

The invention contemplates a modular wall-mountable lavatory unit, particularly adapted to side-by-side adjacent mounting in multiple, and comprising interrelated basin and other lavatory-utility features defined by intermediate and side panels and by the contoured wall and shelf elements by which the panels are integrally connected and mutually reinforced. The unit structure accounts for such complete wall coverage as to be directly applicable to (suspendable from) rough stud-framing of a wall and, if desired, to both sides of a single stud-framed wall. The unit structure is also directly applicable to a wall which externally mounts horizontal courses of water-service and drainage plumbing.

16 Claims, 17 Drawing Figures

MODULAR LAVATORY CONSTRUCTION

This invention relates to structural features of a modular lavatory which is essentially a single integral unit, adapted for multiple side-by-side mounting against and suspension from a single wall.

It is an object of the invention to provide an improved lavatory construction of the character indicated.

It is also an object to provide a wall-mountable lavatory module which shall integrally include a mutually reinforcing combination of basin and storage-bin features between matching protective side panels.

It is a specific object to meet the above objects with a structure lending itself to monoplastic construction, i.e., to single-piece plastic construction.

Another specific object is to meet the above objects with a structure which can obviate the need to finish the wall from which the module is to be suspended, the structure being indeed the finish of the wall.

A further specific object is to meet the above ojbects with a structure which can be served, in multiple array, by horizontal courses of water-supply and drainage plumbing which is mounted externally upon, as distinguished from being contained within the stud or otherwise definitive framing of the wall to which the module is to be mounted.

It is also an object to meet the above objects with structure which, in multiple side-by-side mounted adjacency, can derive its support and alignment from a single horizontal mounting rail that has been leveled and fixed to the wall studding.

A general object is to meet the above objects with unitary wall-mountable molded-plastic structure which represents important economy of material, construction and installation costs, ease of maintenance, and individual convenience and relative privacy in public use.

Other objects and various further features of novelty and invention will be pointed out or will occur to those skilled in the art from a reading of the following specification, in conjunction with the accompanying drawings. In said drawings, which show, for illustrative purposes only, preferred forms of the invention:

Figure 1:
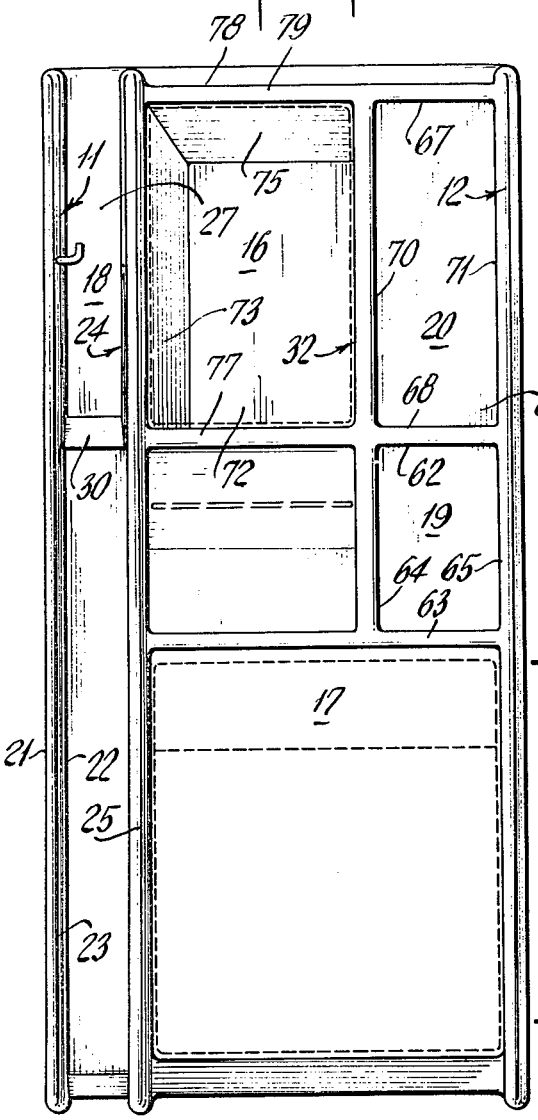
FIG. 1 is a front-elevation view of a complete lavatory modular unit of the invention.
Figure 3:
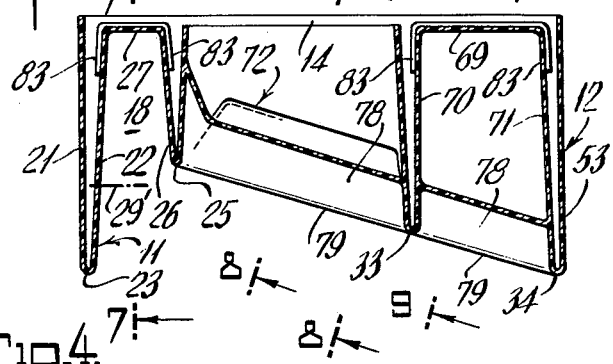
Figure 4:
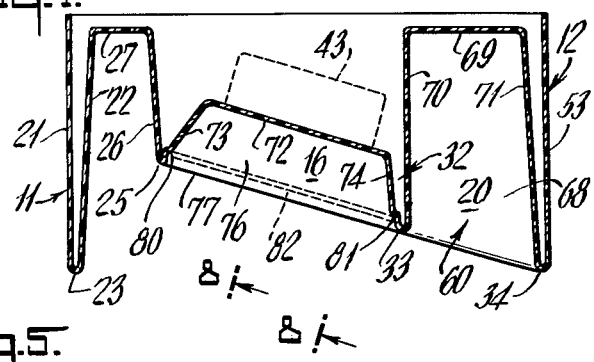
Figure 5:
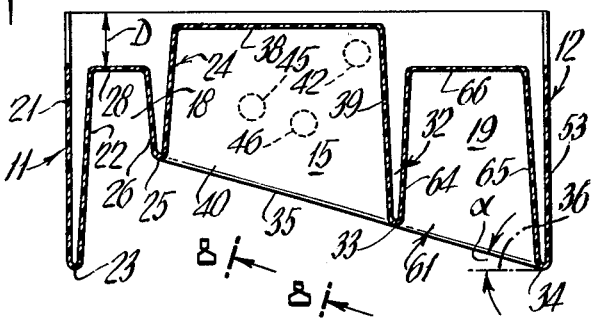
Figure 6:
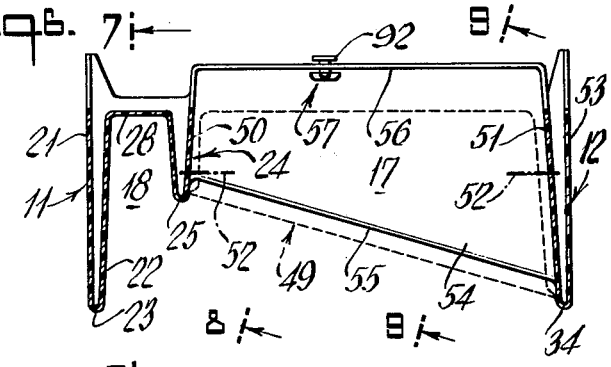
Figure 2A:
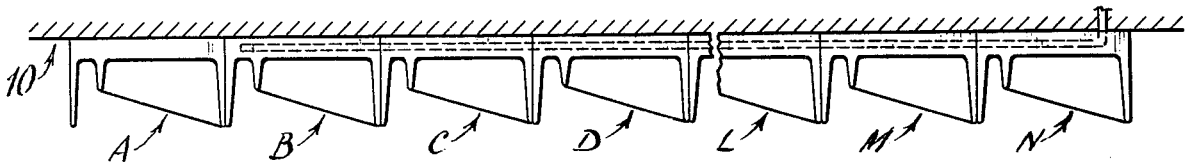
FIGS. 2 and 2A are respectively front-elevation and plan views of a wall-mounted installation, in multiple and on a reduced scale, for the unit of FIG. 1.
Figure 7:
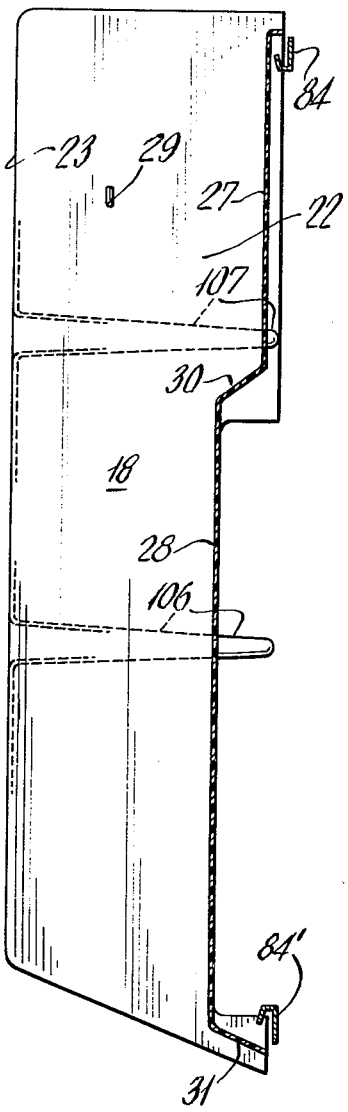
Figure 8:
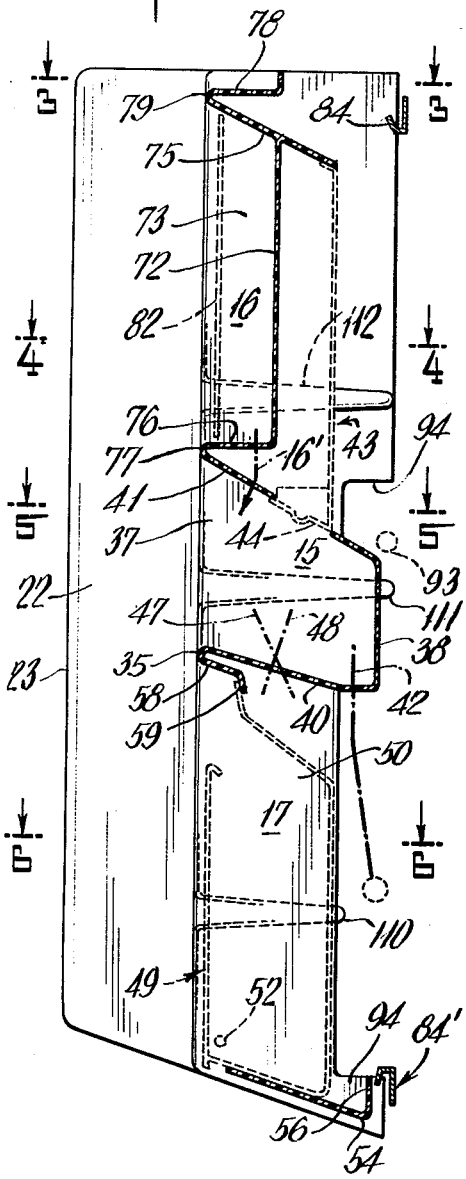
Figure 9:
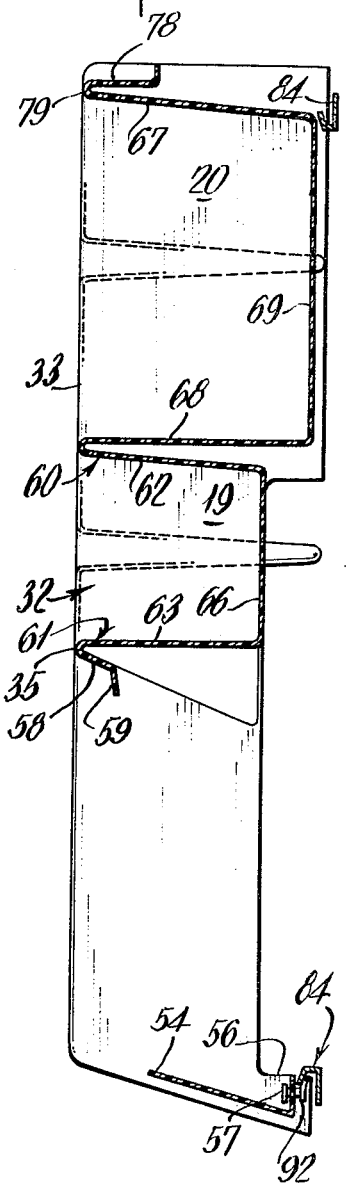
Figure 2:
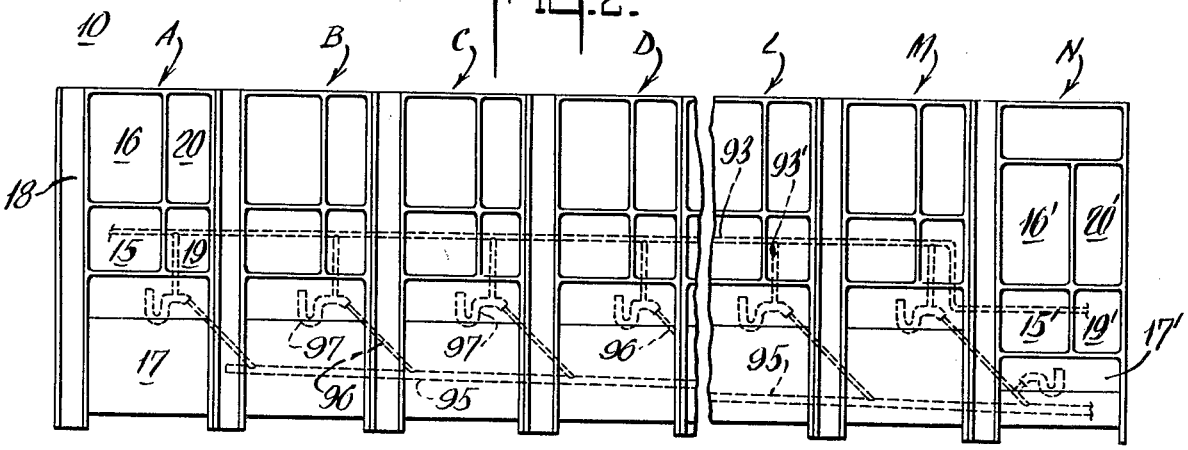
Figure 10:
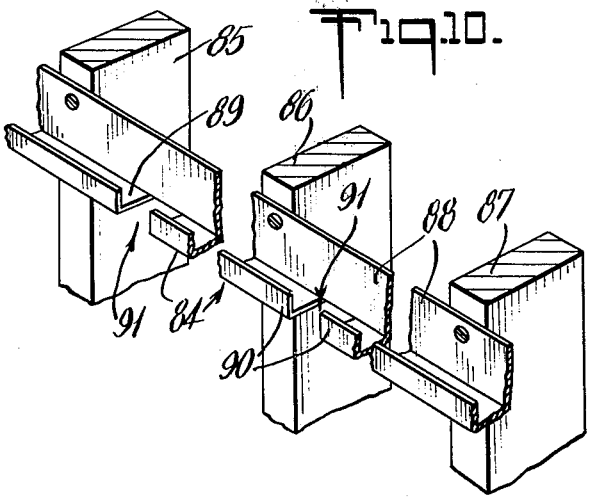
Figure 14:
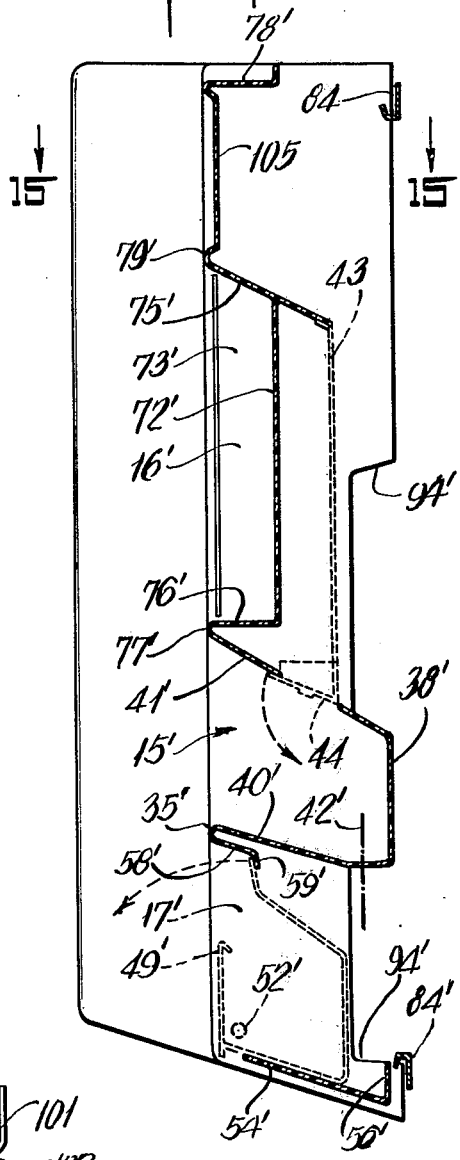
Figure 11:
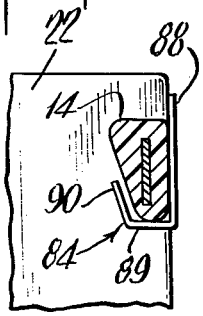
Figure 12:
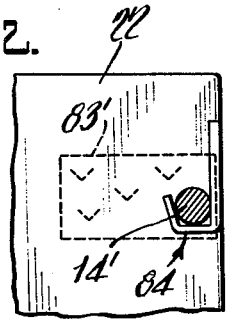
Figure 13:
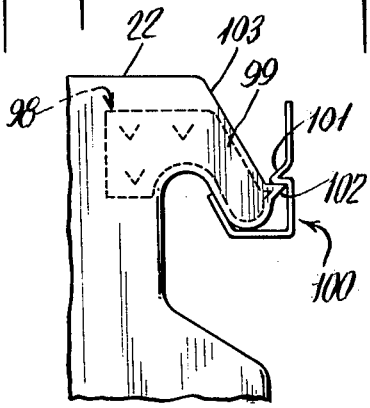
Figure 13A:
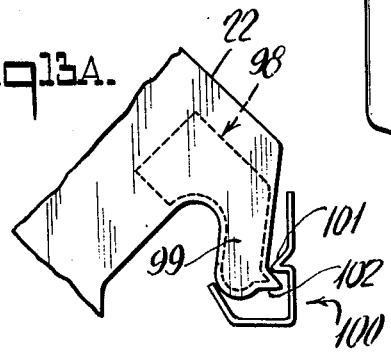
Figure 15:
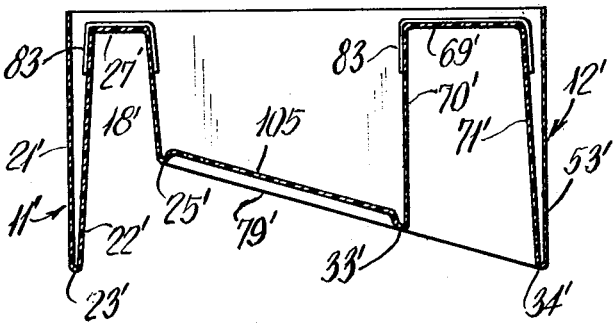

FIGS. 3, 4, 5 and 6 are horizontal sectional views, taken along the respective alignments 3—3, 4—4, 5—5 and 6—6 of FIG. 8;

FIGS. 7, 8 and 9 are vertical sectional views, taken along the respective alignments 7—7, 8—8 and 9—9, as they appear in FIGS. 3 to 6; for convenience, the horizontal sectional planes 3—3, 4—4, 5—5 and 6—6 also appear in FIGS. 7, 8 and 9;

FIG. 10 is a fragmentary perspective view of a rail for use in wall-mounting the units of FIGS. 1 and 2;

FIGS. 11, 12 and 13 are enlarged fragmentary sectional views, taken at the plane 7—7 of FIG. 3, showing alternative rail-engaging wall-mounting means for the unit of FIG. 1;

FIG. 13A is a view similar to FIG. 13 to show coaction of the parts in the course of their engagement and/or disengagement;

FIG. 14 is a vertical sectional view corresponding to FIG. 8, to show modification of the same modular concept for particular accommodation of wheel-chair limited persons, a unit according to FIG. 14 being indicated in front-elevation and plan aspects at the right end of the multiple array shown in FIGS. 2 and 2A; and FIG. 15 is a horizontal sectional view, taken at the plane 15—15 of FIG. 14, other sectional views at planes 3'—3', 4'—4', 5'—5' and 6'—6' of FIG. 14 being as depicted in FIGS. 3, 4, 5, and 6, respectively.

Referring to the drawings, the invention is shown in application to a modular lavatory unit (FIG. 1) which is mountable to a single wall 10 in multiple side-by-side adjacency, as shown for the successive units designated A, B, C, D . . . L, M, N in FIGS. 2 and 2A. These units are shown to completely clear the floor level and the ceiling level, and it will be understood that, if desired, soffet and baseboard structure may be added to fill or otherwise make use of such clearances. Ordinarily, however, simple finish paneling will suffice to cover the wall framing at these clearances, in that each unit of the multiple array A, B, C . . . N will be understood to be its own local wall finish, each unit being independently suspendable from the studs of rough framing for wall 10, as will later be described. For present illustration, each unit is suspended from its own horizontal mounting bar 14 and integrally provides, between vertical side panels 11–12 of like side-elevational profile, multiple front-access personal-convenience features which will initially be identified as regional areas or volumes, namely, a generally centrally located lavatory-basin volume 15, a mirror-surface area 16, a waste-product collection-bin region 17, a garment-hanging bin 18, a small bin 19 at basin height for handbags or other personal effects, and a luggage bin 20 above the bin 19.

In the preferred realization of my invention, the indicated unit construction is a monoplastic molded shell, defined as by slumping plastic sheet over a suitable contoured male die. As a practical matter, the shell is preferably erected upon such a mold, as a built-up succession of resin-soaked fabric laminations, before closure with a matched female die, for development of ultimate surface-finish and contour, while curing under such heat and/or pressure as the particular plastic may require. Thus, forwardly projecting walls and shelves each involve two shell surfaces or panel regions, and back-wall surfaces of bin volumes are single panel regions contiguous to and integral with adjacent and opposite wall surfaces (panel regions) of the same single laminated-plastic shell.

It will be helpful to describe detail of the integral shell, by progressively identifying successive panel regions, proceeding in the left-to-right direction.

Beginning at the left, the vertical side panel 11 is seen to have a generally rectangular side-elevational profile which establishes the overall height and wall-offset (depth) dimensions of the modular unit. Side panel 11 comprises a first, laterally outwardly facing, panel region 21 and a second, laterally inwardly facing, panel region 22. Panel regions 21–22 converge in the forward direction and define a smoothly rounded front vertical edge 23 at their integral connection. The outer panel region 21 extends the full depth dimension of the module, i.e., to the plane of wall-mounting, and is also perpendicular to this plane. An intermediate vertical panel 24 establishes the right-hand wall of the garment bin 18, and also comprises left and right panel regions, convergent to a rounded continuous front vertical edge 25. The leftward panel region 26 of panel 24 extends the full vertical height of the module, and both panel regions 22–26 of the garment bin are continuously formed with upper and lower vertical back-wall regions 27–28. As is particularly clear from FIG. 7, the upper back-wall region 27 is close to the wall-mounting plane, for maximum depth of garment accommodation in the region of clothes-hanger suspension, as from a suitable hook 29, mounted at location 29' after completing the plastic-molding process. The lower back-wall region 28 applies to the elevational regions for which horizontal plumbing courses are applicable, as will later be more fully explained; it suffices to point out that the lower back-wall region 28 is more forwardly offset, to extent D (see FIG. 5), from this plane for concealed accommodation of such plumbing, there being a gently faired first offset connection 30 between regions 27–28 and a second offset return 31 to the mounting plane at the lower end of back-wall region 28.

Before proceeding with panel-region identification for the three central facilities 15-16-17, it will be noted that the uper two of these are defined between spaced intermediate wall panels 24–32, that the upper right facilities 19–20 are defined between intermediate wall panel 32 and the outer wall panel 12, and that the disposal-bin facility is defined between intermediate wall panel 24 and the outer wall panel 12. Panels 32 and 12 have rounded vertical forward edges 33–34, and a geometric vertical plane 35 of alignment of forward edges 25-33-34 is preferably inclined inwardly at an acute angle $\alpha$ (see FIG. 5) with respect to the geometric vertical plane 36 common to the side-panel forward edges 23–34. It will become clear that such inward inclination affords a measure of personal body accommodation (and therefore privacy) within the plane 36 and in the direction of side-wall panel 11.

Returning now to an identification of wall-panel regions of the monoplastic shell, for the vertical alignment of central facilities, a lavatory wall-panel region 37 of intermediate wall panel 24 extends rearwardly from forward edge 25 to maximum depth, at juncture with a lavatory back-wall region 38; similarly, the back-wall region 38 joins a deep lavatory wall-panel region 39 of intermediate wall panel 32. Other surface regions of the lavatory bin 15 are a bottom-panel region 40 and an upper-panel region 41, both having smooth and continuously faired integral connection to the wall regions 37-38-39. Preferably, the bottom-panel region 40 slopes gently downward from the rounded forward edge of the basin, marked 35 because of its coincidence with the rearwardly inclined vertical plane 35 already described, to a locally level (horizontal) region for later cut-out to receive and mount a drainage waste fitting, suggested at 42. Also to be cut out, is a rectangular opening in the upper-panel region 41, for later-inserted reception of a paper-towel dispenser unit 43 having a suitably slotted and sloping bottom panel 44 for matching fit to the panel region 41. Provision for hot and cold water-spray heads and their control valves forms no part of the invention and is therefore merely suggested at 45–46 in FIG. 5, with preference suggested at 47 in FIG. 8 for spray-discharge downward and rearward so that water splash is naturally deflected in the inward direction; the alignment 48 in FIG. 8 will further be understood as an indication of my preference for the control valves to be of self-closing variety and to be located inward of the spray discharge, all washing being performed under spray and not by filling the basin.

beneath facilities 15–19, the collection bin 17 for paper and the like waste is shown as a separably removable basket 49 with pivotal suspension from side-panel regions 50–51 of wall panels 24-12, on a horizontal axis 52; the other half of wall panel 12 is a flat vertical panel region 53 perpendicular to the mounting plane and shaped to conform in profile to the outer panel 21 of wall panel 11, for clear registry when arrayed in multiple side-by-side adjacency, as in FIGS. 2 and 2A. A bottom-wall panel 54 of the module shell integrally connects wall-panel regions 50–51 and imparts structural rigidity to the large cavity for reception of basket 49; in FIG. 6, panel 54 is seen to extend from a forward edge 55 to a rear edge which is upwardly flanged at 56 and equipped with a central bottom-locking device 57, to be later explained. The top-wall panel 58 of the waste-facility cavity 17 is a downwardly and inwardly re-entrant flange, having a short downward lip 59 which serves as a stop and, if desired, also serves as a locking reference to retain the inserted position and orientation of the waste-paper receptacle or basket 49; flange surfaces 58–59 will be understood to integrally connect wall-panel regions 50–51, and upon removal of the basket 49 it will be seen that relatively extensive open installation and maintenance access is available to supply and drain plumbing as well as to the locking device 57.

The small-articles bin 19 alongside the lavatory facility 15 is defined between wall panels 32-12 and is divided from luggage bin 20 and the waste-paper bin 17 by upper and lower shelf panels 60–61. The panel region 62 of shelf panel 60 (see FIG. 9) and the panel region 63 of shelf panel 61 integrally connect panel regions 64–65 of wall panels 32-12, and a back-wall region 66 integrally connects all four of the indicated adjacent surfaces, to complete the smooth continuity of the facility 19. In similar fashion, upper and lower panel regions 67–68, a back-panel region 69, and side-panel regions 70–71 are continuously connected to define the luggage-bin facility 20; depth is at a maximum for luggage accommodation at 20 and is reduced to the extent of the offset D for the small-article facility 19.

Above the lavatory facility 15, panel 72 provides a mounting base for the towel-dispenser insert 43. Panel 72 also continuously and integrally interconnects upper panel regions 73–74 of the intermediate wall panels 24–32 and joins upper and lower shelf-panel regions 75–76. Shelf-panel region 76 is integrally united to the upper basin panel 41 at a rounded horizontal forward edge 77 (in the plane 35), and the shelf-panel region 75 is similarly joined to an upper panel region 78 at a rounded horizontal forward edge 79 (also in the plane 35); panel and edge formations 78–79 for the upper definition of facility 16 have their exact counterpart for the upper definition of facility 20 and so the same numbers are repeated in FIGS. 8 and 9. Finally, to complete the basic shell structure, suitable mounting-ledge or other formations 80-81 are provided in the wall-panel regions 73–74 for mirror-frame reference purposes, mounting-hardware detail for an inserted mirror unit 82 being omitted from drawings.

It has been explained that the horizontal bar or rod 14 serves to suspend and thus sustain the entire wall-mounted and loaded weight of each lavatory module. The section of this bar 14, in one form, appears in FIG. 11 as an elongate molding of plastic about a central reinforcing steel core. Preferably, the steel core is united to strap formations 83, suitably longitudinally positioned to assure firm and well-rooted integration into the wall-panel structure already described, as suggested in FIG. 3 by anchoring overlap with inner parts of wall-panel regions 22-26-70-71.

Unit-suspension from a wall is readily accomplished, using an elongate rail or track member 84, as illustrated in FIG. 10 in mounted application direct to each of a succession of studs 85-86-87 which constitute basic local wall framing. Rail member 84 is shown channel-shaped, with a mounting flange 88 which rises to at least the full vertical extent of the rod section 14 and with a base offset 89 to a retaining-flange portion 90. Preferably, the wall-mounting face of the rod section 14 is flat and parallel to the wall-mounting plane of the lavatory module, for close-positioning reference to the wall, and the outer retaining-flange portion 90 is outwardly sloped to accord with a similar slope of the corresponding part of rod section 14, to enable and promote wall-directed cammed displacement in the course of hanging rod 14 over the rail 84. Preferably, also, rail 84 is notched or cut out, at 91, at module-width spacings to permit entry of wall-mounting edges of the outer panel regions 21-53 of each module, thus longitudinally locking the same in position, and locking adjacent units A-B-C-D, etc., in close-fitting side-by-side relation.

The same basic rail 84 may be inverted and serve an anchoring function for the lower part of the module sheet, as suggested at 84' in FIG. 9, being permanently mounted to the same studs 85-86-87 at the appropriate elevation. The retaining flange 90 then becomes a cam surface for the rotated bolt or dog element 92 (FIG. 6) of the locking element 57, which it will be recalled is accessible through the waste-bin space 17, once receptacle 49 is removed.

It will be seen that the described multiple-facility module (FIG. 1) is inherently structurally sound and self-reinforcing. The integral juxtaposition of tri-planar joints in the definition of all the different facility bins and areas 15-16-17-18-19-20, and their relation to the side and intermediate wall panels 11-24-32-12 and shelves is the essence of inherent reinforcement of one panel region by those contiguous thereto. The structure lies flat to the wall and requires no shim or other corrective measures for any of the multiple units, it being required of course that rails 84–84' be initially installed, in level horizontal orientation.

It will also be seen that the module construction of the invention lends itself to a simplified plumbing installation wherein, for example, horizontal courses of hot and cold supply pipe are mounted directly upon the stud framing of the wall, as suggested in FIGS. 2 and 8 by alignment of such a course 93 for one of these supplies, at an elevation to clear the upper contour of all lavatory bins 15 and to pass through aligned knock-outs or cut-outs, as at 94, in the outer wall-panel regions 21–53, in general register with limits of the offset rear walls 28–66 of the bins 18–19 which are directly involved; branch connection to each module from line 93 is suggested at 93'. In similar fashion, the same technique may be employed in connection with a suitably pitched generally horizontal course 95 of drainage plumbing, having individual branch-Y connection, as at 96, to the traps 97 serving all basin drains; the vertically extensive nature of cut-out 94 and of offset wall 28, beneath the lavatory bin 15 will be understood to accommodate a substantial number of multiple-ganged units, A, B . . . N to the same pitched drainage pipe 95. Of course, access to such plumbing supply and drainage connections is directly and simply available, upon removal of the waste-collection receptacle 49.

Alternate suspension systems for modules of the invention are indicated in FIGS. 12 and 13. In FIG. 13, the hanger bar 14 is replaced by spaced brackets, each bracket comprising a short horizontal steel stud 14' in welded preassembly to a steel base plate 83', suitably pierced to define anchoring teeth. The base plates 83' and their anchoring teeth are imbedded in the wall-panel regions 22–71 in the course of laminar construction of the plastic shell. Studs 14' engage the hanging channel 84 in the manner described in connection with FIG. 11, with entry and location of plates 83' at appropriately spaced cut-outs 91, as will be understood.

In the arrangement illustrated in FIGS. 13 and 13A, a toothed steel plate insert 98 at each suspension point is contoured at a projection 99 thereof to make the only engagement in the wall-mounted suspension rail 100. The wall flange of rail 100 additionally is formed with a small rib, lug or ridge 101 designed for retaining coaction with a local secondary projection 102 of plate 98, and the upper corner of the wall-mounting edge of side-panel regions 21-22-26-27-69-70-71-53 is locally relieved, as on the alignment 103, to permit initial hanger engagement and location with rail 100 at a substantial tilt to the wall (see FIG. 13A). At such an angle of tilt, the secondary projection 102 readily enters under the rib 101 and, once the unit is allowed to swing to final position against the wall, the engaged elements 101–102 interfere to preclude and frustrate any attempted vertical dislodgement of the module.

The lavatory module of the invention has thus far been described in the context of normal use, i.e., for use by most members of the public, for whom basin access at 15, as well as access to the other facilities at 16-17-18-19-20 is convenient from a standing position. With very simple modification of the same dies and construction technique, it is also possible to accommodate handicapped persons who may be wheel-chair limited, i.e., who must be accommodated from a sitting position. Such a modified module is shown at location N in FIGS. 2 and 2A, providing the same convenience facilities 15-16-17-18-19-20, but at appropriately lowered elevation; and a typical full vertical section is depicted in FIG. 14, for the case of the sectional plane corresponding to that in which the section on FIG. 8 is taken for normal adult use. Since parts have such great correspondence, the same reference numerals are used in FIG. 14, but with primed notation. The major modifications are (a) the provision of a recessed integral front filler-panel structure 105 in the module shell between the horizontal front edge 79' at the top ofthe mirror region 16' and (b) the corresponding reduction in vertical extent of the waste-bin insert 49' and its receiving openings 17'; a sectional view of the filler-panel elevation is presented in FIG. 15. Importantly, the same upper and lower mounting rails 84–84', the same water-supply horizontal course, and the same drainage plumbing courses are utilized, with no particular problem of suspension, connection, lock-up or use.

It will be seen that the described embodiments achieve all stated objects with basically simple, structurally sound and mutually reinforcing panel relationships, with all forwardly exposed edges rounded at integral and continuous juncture of two panel regions, thus minimizing the need to resort to additional reinforcement or module-framing of any kind. It is clear that, if desired, steel plates may be added as local reinforcement in the course of shell construction as suggested by reinforcement-plate outlines 106–107 in FIG.

7 and 110-111-112 in FIG. 8, in which case the reinforcement integration into the shell can be accommodated solely at internal locations, thus avoiding any suggestion of the same, from external-appearance considerations. Whether the normal variety (locations A to M) or of the wheel-chair accommodating variety (location N), the modular units having matching side-panel profiles and are rectangular in their full coverage of the wall; they thus may serve as final coverage of basic wall framing, and in fact may be mounted to opposite sides of the same wall framing, without requiring the requisite horizontal plumbing courses to be built into the wall frame, even for accommodation of the modules on both sides of the wall.

While the invention has been described in detail for the preferred forms shown, it will be understood that modifications may be made without departure from the claimed scope of the invention. For example, while monoplastic construction has been indicated as preferred, it will be understood that the basic combination of mutually-reinforcing integrally related panels may also be the product of sheet-metal, vacuum-slumping, casting or other well understood techniques. Also, the various space provisions already identified lend themselves to additional convenience features, as for example, the hinged mounting of mirror 82 so as to provide service access to the space 16 behind the mirror, said space 16 being sufficient to accommodate, for example, a liquid-soap supply, communicating via suitable tubing and valve structure for manually actuated discharge from a central region of the upper wall panel 41 of the basin, all as schematically indicated by a heavy arrow 16' in FIG. 8. In any case, the unusual construction of this invention will be seen to assure an important measure of security and privacy for the person and property of the oocupant, as well as simplicity and convenience for occupant use and for service maintenance.

What is claimed is:

1. A unitary modular lavatory-wall unit for wall-hung mounting in side-by-side adjacent multiple, and having a generally rectangular front elevation between upstanding horizontally spaced side walls which extend forwardly of a wall-mounting plane, said side walls having elongate upstanding forward edges defining a front-access plane parallel to and offset from the wall-mounting plane, comprising a single-piece integral molded plastic structural combination wherein said side walls are upstanding parallel side panels of matching side-elevational contour, said combination including at least one upstanding intermediate wall panel between said side panels and of lesser side-elevational contour than said side panels, said intermediate and side panels being integrally connected by back panel and shelf elements and including a lavatory-basin formation as part of the integral connection of said intermediate wall panel to one of said side panels, said basin formation and said intermediate panel and panel and shelf elements being substantially fully contained within the geometrical volume defined by and between said intermediate wall panel and said one side panel, the rear edges of said vertical side-wall panels being locally recessed from the wall-mounting plane at regions intermediate the upper and lower ends of said rear edges and above and below said lavatory-basin formation, and unit-suspension means carried by said unit adjacent the wall-mounting plane, whereby a plurality of said modular units may be removably hung from a mounting wall equipped with horizontally elongate service-plumbing courses which are outside the geometric volume of the wall.

2. The modular unit of claim 1, in which the integral connection between said intermediate wall panel and the other of said side panels extends substantially the full vertical extent of said unit-height dimension and at a location relatively near the wall-mounting plane of said unit, thereby defining a garment-accommodating space.

3. The modular unit of claim 1, in which said combination is of laminated fabric-reinforced plastic construction.

4. The modular unit of claim 1, in which the lavatory-basin formation includes a horizontal front edge and integral continuous splash-limiting back-wall, side-wall and upper-wall surfaces above the plane of said front edge.

5. The modular unit of claim 4, in which connecting panel elements adjacent and above said upper-wall surface define a towel-retaining volume above the lavatory-basin formation, said upper-wall surface having a towel-discharge slot communicating with the lower end of the towel-retaining volume.

6. The modular unit of claim 4, in which said upper-wall surface has a water-supply opening rearward of the towel-discharge slot.

7. The modular unit of claim 1, in which the lavatory-basin formation includes upper and lower horizontal front edges, integral contiguous splash-limiting back-wall and side-wall surfaces extending between the horizontal planes of said horizontal front edges and below the plane of said lower front edge, and upper and lower surfaces respectively connecting said side-wall surfaces and said back-wall surface to said upper and lower front edges, said upper surface having a water-supply opening and said lower surface having a water-drain opening.

8. The modular unit of claim 7, in which said lower surface is generally flat and has a shallow slope downward and rearward from said lower front edge to substantially the location of juncture with said back-wall surface.

9. The modular unit of claim 1, in which the integral connection between said intermediate wall panel and the other of said side panels includes a shelf-divided article-storing cavity.

10. The modular unit of claim 9, in which said shelf-divided storing cavity is limited substantially to elevations which span and extend above said basin formation, said connecting elements defining a waste-receptacle recess beneath both said basin formation and said storing cavity.

11. In combination, a wall frame with a single elongated wall-mounted horizontal support rail on one side of said wall frame, and a plurality of modular lavatory units according to claim 1, the suspension-means of said units being all suspended in like manner and in side-by-side adjacency from said rail.

12. The combination of claim 11, in which said units and said rail have engaged lateral-position locating formations, the locating formations of said rail being at unit-width spacing, whereby adjacent units are retained in adjacency.

13. The combination of claim 11, further including a single elongated wall-mounted horizontal locking rail at an elevation substantially beneath that of said support rail, each said unit including means releasably engageable to said locking rail.

14. The combination of claim 11, further including an elongate horizontal course of water-supply plumbing external to and carried by said wall frame beneath said rail and above the elevation of the lavatory-basin formations of units suspended by said rail, said plumbing course being within locally recessed regions of the rear edges of said side-wall panels.

15. The combination of claim 11, further including an elongate generally horizontal course of drainage plumbing external to and carried by said wall frame beneath the elevation of the lavatory-basin formations of units suspended by said rail, said plumbing course being within locally recessed regions of the rear edges of said side-wall panels.

16. A unitary modular lavatory-wall unit for wall-hung mounting in side-by-side adjacent multiple, and having a generally rectangular front elevation between upstanding horizontally spaced side walls which extend forwardly of a wall-mounting plane, said side walls having elongate upstanding forward edges defining a front-access plane parallel to and offset from the wall-mounting plane, comprising a single-piece integral molded-plastic structural combination wherein said side walls are upstanding horizontally spaced parallel vertical panels of matching side-elevational contour, said vertical panels being integrally connected by upstanding back-wall panels in horizontally offset relation to the wall-mounting plane and by vertically spaced horizontal panels which are also integrally connected to said back-wall panels, the forward edges of at least two of said vertical panels being spaced less than the unit-width and being in substantial register with a vertical plane which slopes inwardly with respect to the wall-mounting plane, said connecting panels between said two vertical panels including a continuously formed lavatory-basin formation that is recessed rearwardly from the sloping vertical plane and being substantially fully contained within the geometrical volume defined between said two vertical panels, the rear edges of said vertical side-wall panels being locally recessed from the wall-mounting plane at regions intermediate the upper and lower ends of said rear edges and above and below said lavatory-basin formation, and unit-suspension means carried by said unit adjacent the wall-mounting plane, whereby a plurality of said modular units may be removably hung from a mounting wall equipped with horizontally elongate service-plumbing courses which are outside the geometric volume of the wall.

* * * * *